US008596107B1

(12) United States Patent
Wongdao et al.

(10) Patent No.: US 8,596,107 B1
(45) Date of Patent: Dec. 3, 2013

(54) CORRELATION STANDARD FOR CALIBRATING A SCANNING ELECTRON MICROSCOPE

(75) Inventors: Wipawan Wongdao, Bang Pa-In (TH); Yongyut Wongbunnak, Samutprakarn (TH)

(73) Assignee: Western Digital Technologies, Inc., Irvine, CA (US)

( * ) Notice: Subject to any disclaimer, the term of this patent is extended or adjusted under 35 U.S.C. 154(b) by 556 days.

(21) Appl. No.: 12/750,472

(22) Filed: Mar. 30, 2010

(51) Int. Cl.
*G12B 13/00* (2006.01)

(52) U.S. Cl.
USPC ..... 73/1.01; 250/252.1; 250/310; 250/311

(58) Field of Classification Search
USPC ..... 73/1.01; 250/252.1, 310, 311
See application file for complete search history.

(56) References Cited

U.S. PATENT DOCUMENTS

| | | | | |
|---|---|---|---|---|
| 4,992,253 | A * | 2/1991 | Wu et al. | 423/412 |
| 7,057,164 | B2 * | 6/2006 | Springsteen et al. | 250/252.1 |
| 7,323,350 | B2 * | 1/2008 | Dulay et al. | 438/10 |
| 7,453,571 | B1 * | 11/2008 | Tortonese et al. | 356/430 |
| 7,491,934 | B2 | 2/2009 | Jesse et al. | |
| 2003/0177819 | A1 * | 9/2003 | Maale | 73/105 |

* cited by examiner

*Primary Examiner* — Hezron E Williams
*Assistant Examiner* — Paul West

(57) ABSTRACT

A correlation standard for calibrating a scanning electron microscope is provided. The correlation standard comprises a pellet and a metal stub. The pellet comprises a compressed mixture of carbon powder and alumina powder. The pellet is attached to the metal stub with a conductive adhesive.

19 Claims, 4 Drawing Sheets

CORRELATION STANDARD FOR CALIBRATING A SCANNING ELECTRON MICROSCOPE

FIELD

The present invention generally relates to correlation standards and, in particular, relates to correlation standards for calibrating a scanning electron microscope.

BACKGROUND

A scanning electron microscope (SEM) is a type of electron microscope that images a sample surface by scanning it with a high-energy beam of electrons in a raster scan pattern. As the scanning electron beam contacts the surface of a sample, backscattered and/or secondary electrons are emitted from the sample surface. Semiconductor inspection, analysis and metrology may be performed by detecting these secondary electrons. A point-by-point visual representation of the sample may be obtained on a cathode ray tube (CRT) screen or other display device as the electron beam controllably scans the sample.

SEMs operate by creating a beam of electrons accelerated to energies of up to several thousand electron volts. The electron beam may be focused to a small diameter and scanned across a feature of interest in the scanned sample. When the electron beam strikes the surface of the sample, low energy secondary electrons are emitted. The yield of secondary electrons depends on various factors including the work function of the material of the sample, the topography of the sample, the curvature of the sample surface, and the like. These secondary electrons can be employed to distinguish between different materials on a sample surface since different materials may have significantly different work functions. When multiple SEMs are used to analyze the same sample, a need exists for calibrating each of the SEMs with respect to one another.

SUMMARY

In accordance with various aspects of the subject disclosure, a correlation standard for calibrating a scanning electron microscope is provided. The correlation standard comprises a pellet and a metal stub. The pellet comprises a compressed mixture of carbon powder and alumina powder. The pellet is attached to the metal stub with a conductive adhesive.

In accordance with various aspects of the subject disclosure, a method for fabricating a correlation standard for calibrating a scanning electron microscope is provided. The method comprises mixing carbon powder with alumina powder and compressing the mixture into a pellet. The method further comprises attaching the pellet to a metal stub with a conductive adhesive.

According to various aspects of the subject disclosure, a correlation standard for calibrating a scanning electron microscope is provided. The correlation standard comprises a pellet and a metal stub. The pellet comprises a compressed mixture of carbon powder and alumina powder. The ratio of carbon powder to alumina powder in the mixture is between 200:1 and 150:1. The alumina powder comprises particles between 0.5 and 5 micrometers in diameter. The metal stub is attached to the pellet with a conductive adhesive that comprises at least one of carbon and silver.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject disclosure and are incorporated in and constitute a part of this specification, illustrate aspects of the subject disclosure and together with the description serve to explain the principles of the subject disclosure.

DETAILED DESCRIPTION

Figure 1:
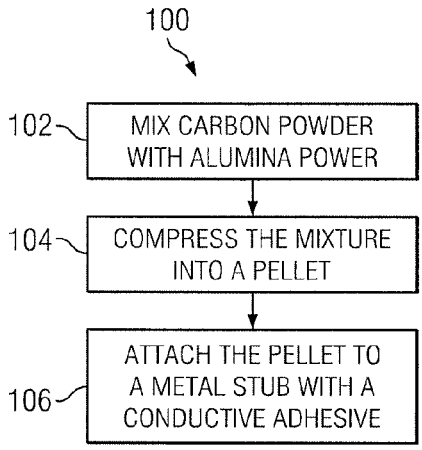
FIG. 1 illustrates an example of a method for fabricating a correlation standard for calibrating an SEM, in accordance with various aspects of the subject disclosure.

In the following detailed description, numerous specific details are set forth to provide a full understanding of the subject disclosure. It will be apparent, however, to one ordinarily skilled in the art that the subject disclosure may be practiced without some of these specific details. In other instances, well-known structures and techniques have not been shown in detail so as not to obscure the subject disclosure.

A scanning electron microscope (SEM) may produce an image of a scanned sample (e.g., an SEM image). The SEM image may be adjusted to have a certain brightness/contrast threshold. Depending on this threshold, more or less detail of the sample may be visible in the SEM image. For example, dark details of the sample may not be visible if the brightness of the SEM image is not adjusted high enough. In another example, if two overlapping components of a sample have similar brightness, then the contrast of the SEM image should be adjusted sufficiently high so that the two overlapping components can be distinguished from one another in the SEM image. Thus, the brightness and contrast of an SEM image may be adjusted in order to render certain details in an SEM image to be visible.

When a sample is scanned by an SEM for hard particle analysis, the brightness/contrast threshold may determine, for example, how many particles from the sample are visible in the SEM image. The visibility of the particles in the SEM image may aid an operator of the SEM in determining the composition of the sample and/or the positions and number of particles in the sample. To verify that different SEMs produce SEM images having the same visibility of particles of a given sample, a correlation standard with known attributes (e.g., particle composition and/or particle position of the correlation standard) may be used as a sample to be scanned by each of the SEMs. Each SEM may then be calibrated such that an SEM image produced of the correlation standard will show substantially the same known attributes of the correlation standard. In this way, the SEMs can be calibrated with respect to one another (e.g., the SEMs produce images having substantially the same brightness/contrast threshold).

Difficulties arise if the correlation standard undergoes a change in its attributes (e.g., a particle composition and/or particle position change) as a result of being scanned by an SEM. This may occur for several reasons. For example, repeated usage of a correlation standard can result in degradation of the correlation standard. Furthermore, contaminant deposition or buildup can occur on the correlation standard, which can have deleterious effects on the measurement of a correlation standard over time. In one example, a correlation standard may comprise alumina ($Al_2O_3$) and carbon tape. The carbon tape may be susceptible to deformation while being scanned by an SEM. The deformation of the carbon tape may lead to changes in the attributes of the alumina, and hence, the correlation standard. If a correlation standard undergoes a particle composition and/or particle position change, then different SEMs may not be accurately calibrated to one another using the same correlation standard.

A correlation standard undergoing a particle composition and/or particle position change can lead to inaccurate results for hard particle analysis qualification. For example, a hard drive manufacturer may insist that suppliers of hard drive components (e.g., suspensions, head gimbal assemblies, arm pivot flex arms, motor base assemblies, top covers, etc.) do not supply components containing greater than a certain number of particle contaminants per given area of each component. To verify that a supplied component does not exceed this number, the supplied component can be scanned by an SEM, and the SEM image of the supplied component can then be inspected for particle contaminants.

However, such a qualification process of the supplied component may entail having a correlation standard scanned multiple times. For example, the correlation standard may be scanned once by an SEM at the supplier side (e.g., to calibrate the SEM and to determine whether or not the supplied component satisfies the condition set forth by the hard drive manufacturer). Subsequently, the correlation standard may be scanned a second time by an SEM at the hard drive manufacturer side (e.g., to calibrate the SEM and to verify that the supplied component satisfies the condition). If the correlation standard undergoes a particle composition and/or particle position change as a result of any of the scans, then the two SEMs would not be accurately calibrated to one another. In this regard, the image produced from each of the SEMs may display a different number of particle contaminants per given area of the component.

Thus, it is beneficial to have a correlation standard that remains substantially the same and does not undergo significant particle composition and/or particle position change despite being scanned multiple times by different SEMs. According to various aspects of the subject disclosure, a correlation standard for calibrating an SEM is provided. In some aspects, the correlation standard is not volatile during SEM scanning. In some aspects, the correlation standard may be scanned multiple times by different SEMs without substantial change to the particle position and/or composition of the correlation standard.

FIG. 1 illustrates an example of a method 100 for fabricating a correlation standard for calibrating an SEM, in accordance with various aspects of the subject disclosure. Method 100 comprises mixing carbon powder with alumina powder (step 102), compressing the mixture into a pellet (step 104), and attaching the pellet to a metal stub with a conductive adhesive (step 106). In some aspects, such a correlation standard can be scanned multiple times by different SEMs without substantial change to the particle position and/or composition of the correlation standard. For example, the correlation standard may be scanned greater than or equal to about five times by one or more SEMs without substantial change to the particle position and/or composition of the correlation standard. In some aspects, the correlation standard may be scanned greater than or equal to about ten times without substantial change to the particle position and/or composition of the correlation standard. Still in some aspects, the correlation standard may be scanned greater than or equal to about 20 times without substantial change to the particle position and/or composition of the correlation standard.

Referring to step 102, carbon powder and alumina powder are mixed to form a mixture, in accordance with various aspects of the subject disclosure. Carbon powder is used because carbon is displayed with low brightness compared to other elements and compounds in an SEM image. In this regard, carbon may be beneficially used as a dark background for the SEM image. Alumina powder is used because, compared to other elements and compounds, alumina is displayed with low contrast relative to carbon in an SEM image. Thus, if an SEM is calibrated such that its SEM image is able to display alumina on a carbon background, then other particles with a higher contrast relative to carbon will also likely be visible. However, the subject technology is not limited to carbon and alumina. Other suitable elements and/or compounds known to those of ordinary skill in the art may be used.

In some aspects, alumina powder, for example as supplied by Merck & Co., Inc. may be used. In some aspects, the alumina powder of the mixture may comprise particles between about 0.5 and 5 micrometers in diameter. In some aspects, carbon powder that is commonly referred to as "carbon 20/40 powder" (graphite+carbon black) or "CARBOTRAP 20/40 mesh 10 GM" may be used. In some aspects, a pestle and a mortar may be used to break apart any agglomerated portions of alumina powder or carbon powder. Subsequently, alumina powder and carbon powder may be weighed to determine the amount of alumina powder and carbon powder to be mixed with one another. In some aspects, the ratio of carbon powder to alumina powder in the mixture may be about 200:1. For example, the mixture may comprise about 0.2 grams of carbon powder 36 and about 0.001 grams of alumina powder. In some aspects, the ratio of carbon powder to alumina powder in the mixture may be between about 200:1 and 150:1. These proportions allow for a homogenous distribution of the alumina powder among the carbon powder in the mixture after the mixture is compressed into a pellet. These proportions also allow for low clustering of alumina particles.

Other suitable ratios of carbon powder to alumina powder in the mixture may be used. For example, a lower ratio of carbon powder to alumina powder may result in a higher incidence of clustering among alumina particles, which in turn may lead to larger areas of the alumina powder being visible in a resulting SEM image of the correlation standard. A higher ratio of carbon powder to alumina powder, for example, may result in a lower incidence of clustering among alumina particles, which in turn may lead to smaller areas of the alumina powder being visible in a resulting SEM image of the correlation standard.

In some aspects, the mortar may be used to mix the carbon powder with the alumina powder. In some aspects, the carbon powder and the alumina powder may be mixed for a duration of about 15 minutes, for example when about 0.2 grams of carbon powder and about 0.001 grams of alumina powder are used. In some aspects, the carbon powder and the alumina powder may be mixed for a longer duration. For example, carbon powder and alumina powder may be mixed for a duration greater than or equal to about 15 minutes when larger quantities of carbon powder and alumina powder are used. The carbon powder and the alumina powder can be mixed at ambient room temperature, which may range anywhere from about 64 to 77 degrees Fahrenheit. There may be other methods of mixing carbon powder with alumina powder. For example, carbon powder and alumina powder may be mixed with a blender or with other suitable means known to those of ordinary skill in the art.

Figure 2:
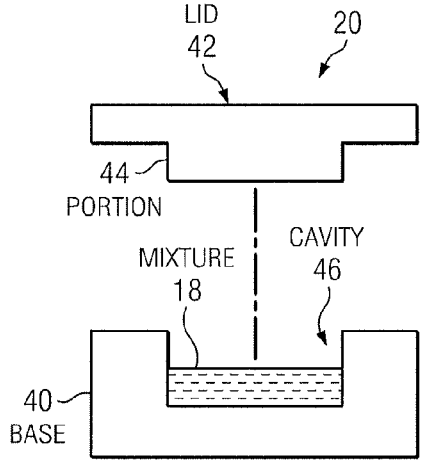
FIG. 2 illustrates an example of a casting set used for compressing a mixture into a pellet, in accordance with various aspects of the subject disclosure.

Referring to step 104, the mixture formed in step 102 is compressed into a pellet. FIG. 2 illustrates an example of a casting set 20 used for compressing a mixture 18 (e.g., the mixture formed in step 102) into a pellet, in accordance with various aspects of the subject disclosure. The casting set 20 comprises a base 40 and a lid 42. The base 40 comprises a cavity 46 for holding the mixture 18 before the mixture 18 is compressed. The lid 42 is fitted over the base 40 such that a portion 44 of the lid 42 enters the cavity of the base 40. The mixture 18 is compressed, for example, by using a hydraulic pressing machine to press the lid 42 against the base 40 such that the portion 44 compresses against the mixture 18 in the cavity 46. In some aspects, the hydraulic pressing machine applies between about 3 and 3.5 tons of pressure to the casting set 20 holding the mixture 18. Thus, the mixture 18 is compressed into the pellet. The casting set 20 may be shaped such that when it is compressed by the hydraulic pressing machine, a surface of the pellet (e.g., an exposed surface to be scanned by an SEM) may be substantially planar. In some aspects, the mixture 18 is compressed for a duration of between about five and ten seconds. In some aspects, the mixture 18 is compressed at ambient room temperature, which can range anywhere from about 64 to 77 degrees Fahrenheit. The relative humidity at which the mixture 18 is compressed may be between about 40% and 60%.

Figure 3A:
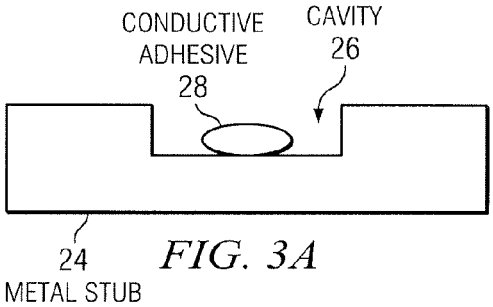
FIGS. 3A, 3B, 3C and 3D illustrate an example of a method for attaching a pellet to a metal stub with a conductive adhesive, in accordance with various aspects of the subject disclosure.

Referring to step 106, the pellet is attached to a metal stub with a conductive adhesive. FIGS. 3A, 3B, 3C and 3D illustrate an example of a method for attaching a pellet 34 (e.g., the pellet formed in step 104) to a metal stub 24 with a conductive adhesive 28, in accordance with various aspects of the subject disclosure. As shown in FIG. 3A, a metal stub 24 is provided for holding the pellet 34. The metal stub 24 comprises a cavity 26 for holding a pellet 34. Although only one cavity 26 is shown, one or more cavities 26 may be formed on the same metal stub 24 for holding one or more pellets 34. The metal stub 24 may be made of aluminum or other suitable metals known to those of ordinary skill in the art.

Figure 3B:
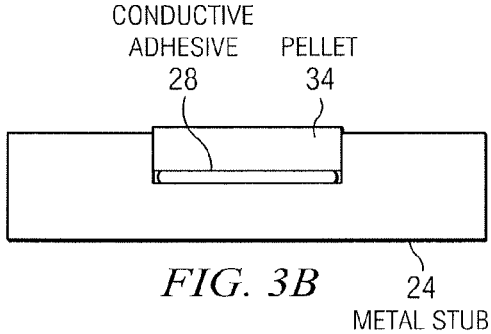

Referring to FIGS. 3A and 3B, a conductive adhesive 28 is applied in the cavity 26 such that the pellet 34 can be pushed into the cavity 26 and fastened to the metal stub 24 using the conductive adhesive 28. In some aspects, the conductive adhesive 28 comprises at least one of carbon and silver. For example, the conductive adhesive 28 may comprise silver adhesive liquid or other suitable conductive adhesives known to those of ordinary skill in the art.

Figure 3C:
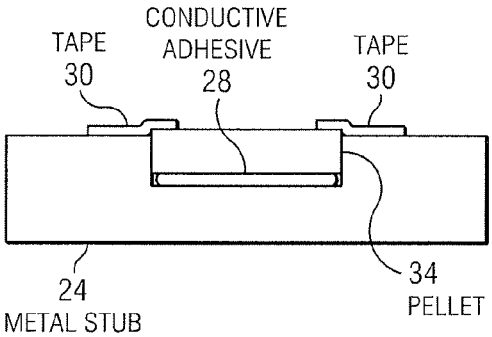

As shown in FIG. 3C, a tape 30 is placed on top of the pellet 34 and the metal stub 24 in order to secure the pellet 34 within the cavity 26. In some aspects, the tape 30 comprises carbon adhesive tape or other suitable tape known to those of ordinary skill in the art. The tape 30 may be applied such that portions of the pellet 34 are exposed for scanning by an SEM. For example, although the tape 30 may be applied over both the pellet 34 and the cavity 26 for securing the pellet 34 within the cavity 26, the tape 30 may also comprise a cutout section for exposing a surface of the pellet 34. The cutout section of the tape 30 may be circular, rectangular, or other suitable shapes.

Figure 3D:
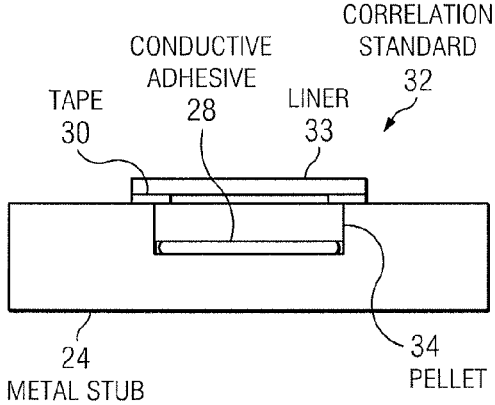

FIG. 3D illustrates an example of a correlation standard 32, in accordance with various aspects of the subject disclosure. The correlation standard 32 comprises the pellet 34 and the metal stub 24, wherein the pellet 34 is attached to the metal stub 24 using the conductive adhesive 28. After the pellet 34 is attached to the metal stub 24 with the conductive adhesive 28, the correlation standard 32 may be baked in an oven at about 240 degrees Fahrenheit (about 120 degrees Celsius) for about 30 minutes.

In some aspects, a clean liner 33 is placed over the exposed surface of the correlation standard 32 to prevent contamination to the correlation standard 32. This may be useful, for example, when the correlation standard 32 is being transported from one location to another, in which contamination by foreign particles may be likely. The clean liner 33 may be removed before the correlation standard 32 is scanned by an SEM.

Figure 4B:
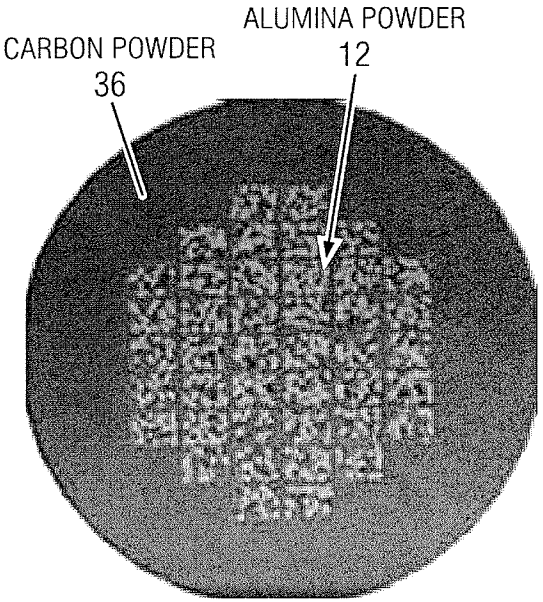
FIGS. 4A and 4B illustrate an example of an SEM image and an example of an energy-dispersive X-ray spectroscope (EDS) image, respectively, of a correlation standard, in accordance with various aspects of the subject disclosure.
Figure 4A:
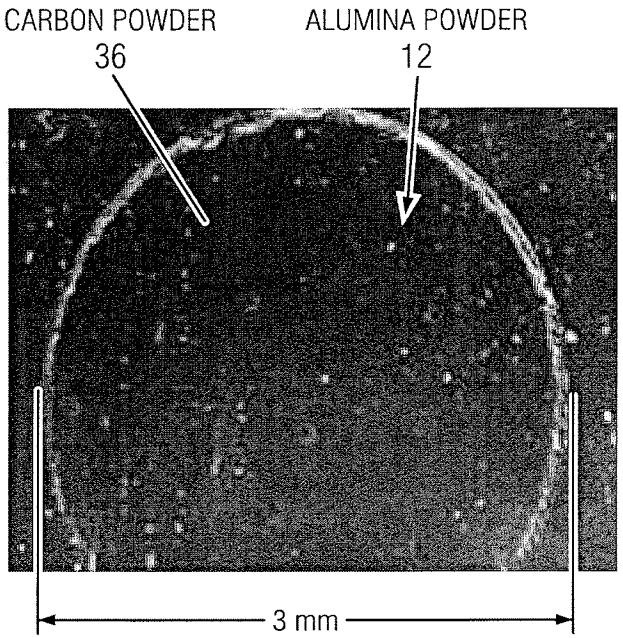
Figures 5A, 5B, 5C, 5D:
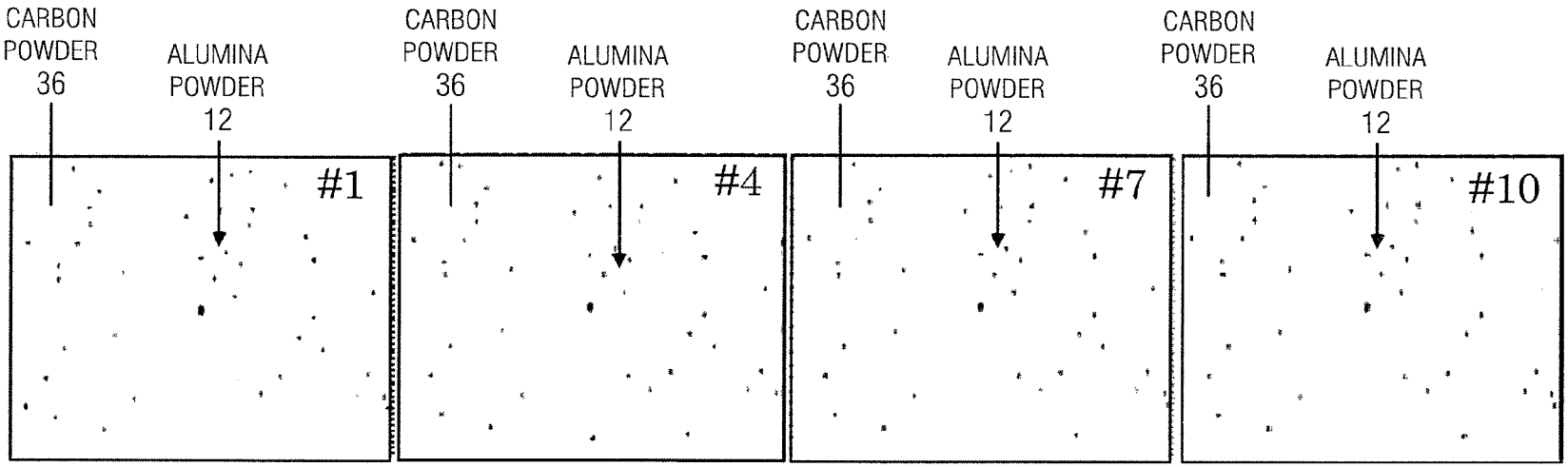
FIGS. 5A, 5B, 5C and 5D illustrate examples of SEM images of the correlation standard, in accordance with various aspects of the subject disclosure.

FIGS. 4A and 4B illustrate an example of an SEM image and an example of an energy-dispersive X-ray spectroscope (EDS) image, respectively, of a correlation standard 32, in accordance with various aspects of the subject disclosure. The scattered specks shown in FIGS. 4A and 4B are the alumina powder 12 dispersed across the exposed surface of the correlation standard 32. The carbon powder 36 of the correlation standard 32 is displayed as the dark background of the SEM and EDS images. This enables the alumina powder 12 to be visible as the scattered specks. As shown in FIG. 4A, the exposed surface of the correlation standard 32 comprises a circular face with a three millimeter diameter. However, the correlation standard 32 may have other suitable dimensions known to those of ordinary skill in the art.

FIGS. 5A, 5B, 5C and 5D illustrate examples of SEM images of the correlation standard 32, in accordance with various aspects of the subject disclosure. The color of these images have been inverted so that the alumina powder 12 is displayed as dark specks and the carbon powder 36 is displayed as a white background. FIGS. 5A, 5B, 5C and 5D each show an SEM image of the correlation standard 32 after having been scanned by an SEM one time, four times, seven times, and ten times, respectively. As shown in these figures, the position of the alumina powder 12 remained substantially the same even after the correlation standard 32 was scanned multiple times by the SEM.

Figure 6A:
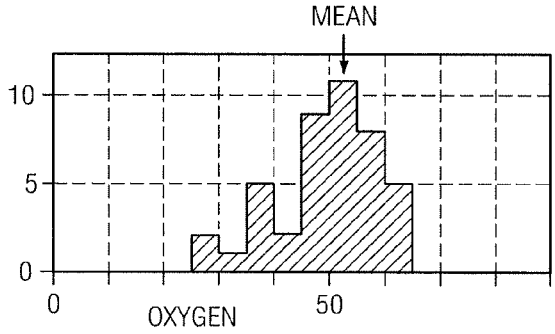
FIGS. 6A, 6B and 6C illustrate examples of graphical representations of the composition of alumina from the correlation standard, in accordance with various aspects of the subject disclosure.
Figure 6B:
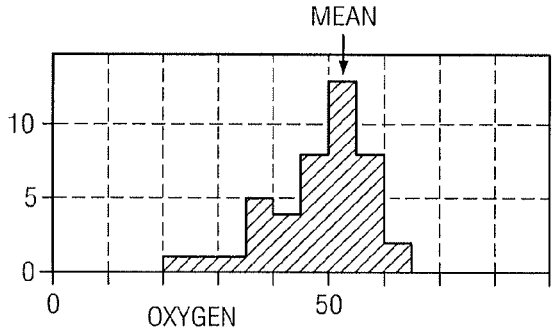
Figure 6C:
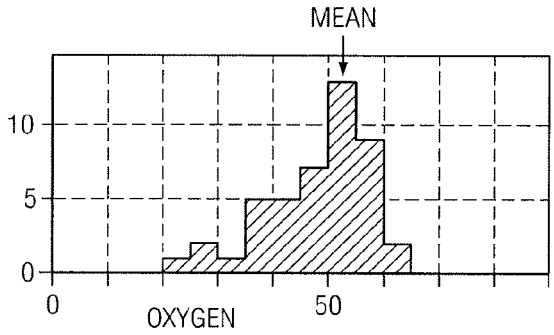

FIGS. 6A, 6B and 6C illustrate examples of graphical representations of the composition of alumina from the correlation standard 32, in accordance with various aspects of the subject disclosure. These graphical representations illustrate how the correlation standard 32 remains substantially the same in its particle composition even after being scanned multiple times by an SEM. In each of these figures, a plot of the composition of alumina from the correlation standard 32 is provided, in which the population of oxygen particles of the alumina is represented on the Y-axis while the weight percentage of oxygen of the alumina is represented on the X-axis. FIGS. 6A, 6B and 6C illustrate such a plot after the correlation standard 32 had been scanned by the SEM one time, five times, and ten times, respectively. As shown in these plots, the weight percentage of oxygen of the alumina remained substantially the same even after the correlation standard 32 was scanned multiple times by the SEM. The mean percentage of oxygen is shown as remaining substantially the same between all three plots.

Figure 7:
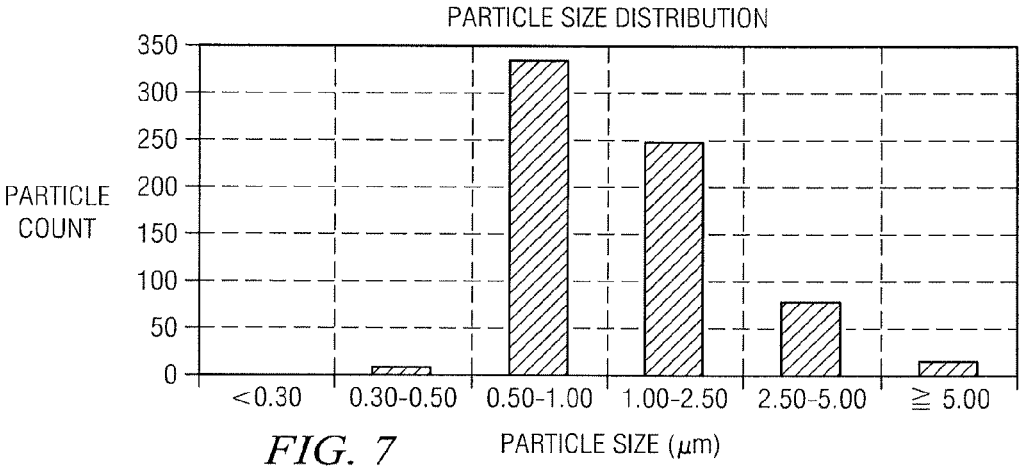
FIG. 7 illustrates an example of a particle size distribution of a correlation standard, in accordance with various aspects of the subject disclosure.

FIG. 7 illustrates an example of a particle size distribution of a correlation standard 32, in accordance with various aspects of the subject disclosure. FIG. 7 provides an example of a plot of the particle size distribution of alumina powder 12 of a correlation standard 32, in which the particle count of the alumina powder 12 is represented on the Y-axis while the particle size (in micrometers) is represented on the X-axis. As shown in this figure, the particle size distribution of the alumina powder 12 ranges from about 0.5 to 5.0 micrometers in diameter. In some aspects, other particle size distributions of the alumina powder 12 may be possible.

The foregoing description is provided to enable a person skilled in the art to practice the various configurations described herein. While the present invention has been particularly described with reference to the various figures and configurations, it should be understood that these are for illustration purposes only and should not be taken as limiting the scope of the invention.

There may be many other ways to implement the invention. Various functions and elements described herein may be partitioned differently from those shown without departing from the scope of the invention. Various modifications to these configurations will be readily apparent to those skilled in the art, and generic principles defined herein may be applied to other configurations. Thus, many changes and modifications may be made to the invention, by one having ordinary skill in the art, without departing from the scope of the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. A correlation standard for calibrating a scanning electron microscope (SEM), the correlation standard comprising:

a pellet comprising a compressed mixture of carbon powder and alumina powder for adjusting a brightness and/or a contrast of an SEM image of the SEM, wherein the pellet is configured such that the SEM image displays alumina on a carbon background; and a metal stub, wherein the pellet is attached to the metal stub with a conductive adhesive.

2. The correlation standard of claim 1, wherein the ratio of carbon powder to alumina powder in the mixture is between 200:1 and 150:1.

3. The correlation standard of claim 1, wherein the mixture comprises 0.2 grams of carbon powder and 0.001 grams of alumina powder.

4. The correlation standard of claim 1, wherein the alumina powder comprise particles between 0.5 and 5 micrometers in diameter.

5. The correlation standard of claim 1, wherein an exposed surface of the pellet is planar.

6. The correlation standard of claim 1, wherein the conductive adhesive comprises at least one of carbon and silver.

7. A method for fabricating a correlation standard for calibrating a scanning electron microscope (SEM), the method comprising:

mixing carbon powder with alumina powder;

compressing the mixture into a pellet for adjusting a brightness and/or a contrast of an SEM image of the SEM, wherein the pellet is configured such that the SEM image displays alumina on a carbon background; and attaching the pellet to a metal stub with a conductive adhesive.

8. The method of claim 7, wherein the ratio of carbon powder to alumina powder in the mixture is between 200:1 and 150:1.

9. The method of claim 7, wherein the mixture comprises 0.2 grams of carbon powder and 0.001 grams of alumina powder.

10. The method of claim 9, wherein the carbon powder and the alumina powder are mixed for a duration of 15 minutes.

11. The method of claim 7, wherein the carbon powder and the alumina powder are mixed at ambient room temperature.

12. The method of claim 7, wherein the alumina powder comprise particles between 0.5 and 5 micrometers in diameter.

13. The method of claim 7, wherein the mixture is compressed into the pellet with a hydraulic press.

14. The method of claim 7, wherein the mixture is compressed into the pellet using between 3 and 3.5 tons.

15. The method of claim 7, wherein the mixture is compressed for a duration of between 5 and 10 seconds.

16. The method of claim 7, wherein an exposed surface of the pellet is planar.

17. The method of claim 7, wherein the conductive adhesive comprises at least one of carbon and silver.

18. A correlation standard for calibrating a scanning electron microscope (SEM), the correlation standard comprising:

a pellet comprising a compressed mixture of carbon powder and alumina powder for adjusting a brightness and/or a contrast of an SEM image of the SEM, wherein the pellet is configured such that the SEM image displays alumina on a carbon background, wherein the ratio of carbon powder to alumina powder in the mixture is between 200:1 and 150:1, and wherein the alumina powder comprises particles between 0.5 and 5 micrometers in diameter; and a metal stub attached to the pellet with a conductive adhesive, the conductive adhesive comprising at least one of carbon and silver.

19. The correlation standard of claim 18, wherein the mixture comprises 0.2 grams of carbon powder and 0.001 grams of alumina powder.

* * * * *